US007976776B2

(12) United States Patent
Coda et al.

(10) Patent No.: US 7,976,776 B2
(45) **Date of Patent: *Jul. 12, 2011**

(54) MERCURY DISPENSING COMPOSITIONS AND MANUFACTURING PROCESS THEREOF

(75) Inventors: Alberto Coda, Gerenzano VA (IT); Alessio Corazza, Como CO (IT); Alessandro Gallitognotta, Origgio VA (IT); Vincenzo Massaro, Albairate MI (IT); Mario Porro, Caronno Pertusella VA (IT); Luca Toia, Carnago VA (IT)

(73) Assignee: Saes Getters S.p.A., Lainate MI (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/683,665

(22) Filed: Jan. 7, 2010

(65) Prior Publication Data

US 2010/0112369 A1 May 6, 2010

Related U.S. Application Data

(63) Continuation of application No. 11/568,211, filed as application No. PCT/IT2005/000389 on Jul. 7, 2005, now Pat. No. 7,674,428.

(30) Foreign Application Priority Data

Jul. 23, 2004 (IT) ..... MI2004A1494

(51) Int. Cl.
*C22C 30/02* (2006.01)
*B22F 1/00* (2006.01)
*H01J 61/28* (2006.01)

(52) U.S. Cl. ..... 420/587; 148/442; 148/513; 420/590

(58) Field of Classification Search ..... 148/53, 148/514, 442, 513; 252/181.2, 181.3, 181.6; 313/550–566; 420/580–589
See application file for complete search history.

(56) References Cited

U.S. PATENT DOCUMENTS

| | | | | |
|---|---|---|---|---|
| 3,636,302 | A * | 1/1972 | Porta et al. | 392/389 |
| 3,657,589 | A | 4/1972 | Della Porta et al. | |
| 5,520,560 | A * | 5/1996 | Schiabel et al. | 445/9 |
| 5,830,026 | A | 11/1998 | Schiabel et al. | |
| 5,831,385 | A * | 11/1998 | Schiabel et al. | 313/550 |
| 5,876,205 | A | 3/1999 | Schiabel et al. | |
| 6,107,737 | A | 8/2000 | Porta | |

FOREIGN PATENT DOCUMENTS

| | | | |
|---|---|---|---|
| EP | 0669639 | A1 | 8/1995 |
| EP | 0691670 | A2 | 1/1996 |
| EP | 0737995 | A2 | 10/1996 |
| EP | 0981826 | A1 | 11/2003 |
| GB | 2056490 | A | 3/1981 |
| IT | EP 981826 | B1 * | 5/2003 |

* cited by examiner

*Primary Examiner* — George Wyszomierski
*Assistant Examiner* — Mark L Shevin
(74) *Attorney, Agent, or Firm* — Panitch Schwarze Belisario & Nadel LLP

(57) ABSTRACT

Compositions are disclosed comprising mercury, titanium, copper and one or more of tin, chromium and silicon, useful for the release of mercury in applications requiring the same, in particular in fluorescent lamps. A process for the preparation of these compositions is also disclosed.

16 Claims, 2 Drawing Sheets

30
31
33
32

MERCURY DISPENSING COMPOSITIONS AND MANUFACTURING PROCESS THEREOF

CROSS-REFERENCE TO RELATED APPLICATIONS

This application is a continuation of U.S. patent application Ser. No. 11/568,211, filed Oct. 23, 2006 and issued as U.S. Pat. No. 7,674,428, which is a section 371 of International Application No. PCT/IT2005/000389, filed Jul. 7, 2005, which was published in the English language on Jan. 26, 2006 under International Publication No. WO 2006/008771 A1 and the disclosure of which is incorporated herein by reference.

BACKGROUND OF THE INVENTION

The present invention relates to mercury dispensing compositions, as well as a manufacturing process thereof.

The compositions of the invention, thanks to their characteristics of stability in air and at low temperatures, and also of mercury release at high temperatures, are particularly suitable for the use in dosing mercury inside fluorescent lamps.

As known, fluorescent lamps require for their operation a gaseous mixture of noble gases at pressures of some hundreds of hectoPascal (hPa) and few milligrams of mercury vapor. In the past mercury was introduced into the lamps in liquid form, either by causing the same to drop directly into the lamp, or inside of small glass vials which afterwards were opened inside the lamp. However, due to the toxicity of mercury, the most recent international regulations have imposed the use of the lowest possible quantity of the element compatible with the lamps functionality; this has rendered the methods of liquid dosage obsolete, because these are not able to provide an exact and reproducible dosing in lamps of small quantities, up to about one milligram, of mercury.

Another method for the introduction of mercury into lamps is through the use of metal amalgams. The mercury release from these materials is however gradual, and starts already at relatively low temperatures, e.g. between 100 and 300° C., depending on the metal to which mercury is amalgamated. Because the manufacturing of lamps foresees operations that take place at relatively high temperatures when the lamp is not yet sealed, this results in the loss of a fraction of the mercury from the lamp and its release to the working environment; for example the sealing of the lamp is normally obtained by compression, under heating at about 500° C., of an open end thereof, and in this operation the amalgam can release to the outside a not negligible fraction of the initially contained mercury.

The applicant has proposed in the past various solid products which allow to overcome the problems seen before.

U.S. Pat. No. 3,657,589 discloses $Ti_xZr_yHg_z$ compounds, which do not release mercury when heated up to about 500° C., but can release it when heated to about 800-900° C. (so-called activation treatment); the preferred compound of this family is $Ti_3Hg$, sold under the trade name St 505. Compared to liquid mercury this compound has the advantage that it can be powdered and dosed into small weight quantities, for example by rolling the powders on a metallic strip with a known linear loading of mercury, and cutting from such a strip sections of the desired length, corresponding to the required weight of mercury. It has however been observed that the mercury release from such a material during the activation treatment is poor, between about 30 and 40% of the total mercury content; it is believed that the reason is an alteration of the material during the final operations of the manufacturing process of the lamps, during which the compound is exposed to oxidizing gases (air or gases released from the glass walls of the lamp itself during the heat sealing treatment). As a consequence, for a given quantity of mercury required by the lamp operation, the dosage by $Ti_3Hg$ requires the use of a quantity of mercury which is at least double or even three times, such a characteristic being in contrast to the stringent regulations mentioned above.

British patent application GB-A-2,056,490 discloses Ti—Cu—Hg compositions having better properties of mercury release compared to those of the compounds according to U.S. Pat. No. 3,657,589. In particular, these compounds are stable in air up to about 500° C., while by heating up to 800-900° C. they release quantities of mercury of more than 80%, or even up to 90%. However, these materials are characterized by a certain degree of plasticity, which makes difficult their milling. Since the manufacturing of devices containing these compounds, as well as the control of the uniform loading with mercury (linear in the case of strip or wire devices, per device in the case of discrete containers) requires the powdering of the compounds, these milling difficulties have in fact hindered the industrial use of these compounds.

The U.S. Pat. No. 5,520,560, U.S. Pat. No. 5,830,026 and U.S. Pat. No. 5,876,205 disclose combinations of powders of the compound St 505 with a promoter of the mercury yield (respectively, copper-tin alloys with possible additions of small quantities of other transition elements; copper-silicon alloys; and copper-tin-rare earths alloys); the addition of the promoter allows to increase the mercury yield from the compound St 505 up to values of 80-90%, even after its oxidation, thus solving the problem of the need of using a large excess of mercury, as resulting from the compound St 505 used alone. The use of a mixture of different powders raises however some problems in the manufacturing process of the devices containing the same: first of all, the two materials have different densities and rheological properties, and consequently they can separate from each other inside of the loading systems (e.g. the hoppers), causing thereby inhomogeneities in the mercury distribution. Furthermore, it has been found that, during the activation treatment, devices containing this mixture of powders may in some cases give rise to the ejection of powder particles of the promoter; although the phenomenon does not occur often and the ejected quantities are limited, this represents a problem in the manufacturing lines of the lamps.

BRIEF SUMMARY OF THE INVENTION

Object of the present invention is to provide mercury dispensing compositions which do not show the problems set forth above, and at the same time provide a manufacturing process for these compositions.

This and other objects are obtained according to the present invention by means of compositions comprising mercury, titanium, copper and one or more elements chosen among tin, chromium and silicon, in which the elements are present according to the following weight percentages:

titanium from 10% to 42%;

copper from 14% to 50%;

one or more elements chosen among tin, chromium and silicon from 1% to 20%;

mercury from 20% to 50%.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

The inventors have found that the above-mentioned compositions have a mercury release of practically zero at temperatures up to about 500° C., a yield higher than 80% during thermal treatments of activation at 800° C. at least, and are brittle and easy to be produced into powders of desired particle size. Preferred compositions are those in which the elements are present in the following weight percentages:

titanium from 14% to 35%;

copper from 20% to 45%;

one or more elements chosen among tin, chromium and silicon from 2% to 14%;

mercury from 30% to 45%.

The compositions of the invention are multi-phase systems; as verified by X-ray fluorescence microanalysis, these compositions include several different compounds, and distinguishing the various phases thereof and attributing to them an exact chemical formula results very complicated. In case of titanium-copper-tin-mercury compositions it has however been possible to identify a compound of the approximate composition given in weight percentages:

titanium 14.5±0.3%;

copper 42.6±0.6%;

tin 2.9±0.1%;

mercury 40.5±4%.

Figure 1:
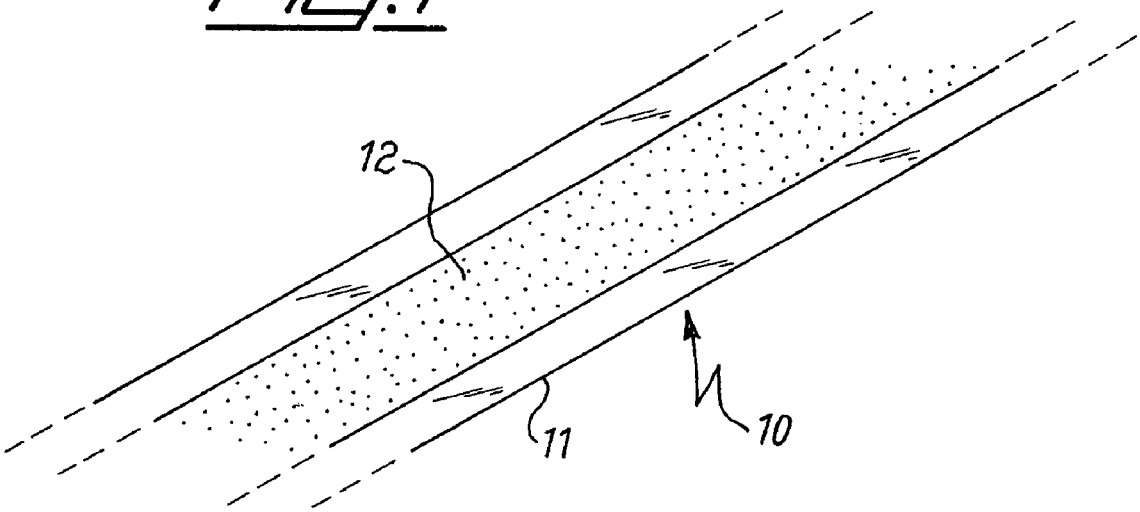
FIG. 1 shows a mercury dispensing device of the present invention which is formed as a metallic strip.
Figure 2:
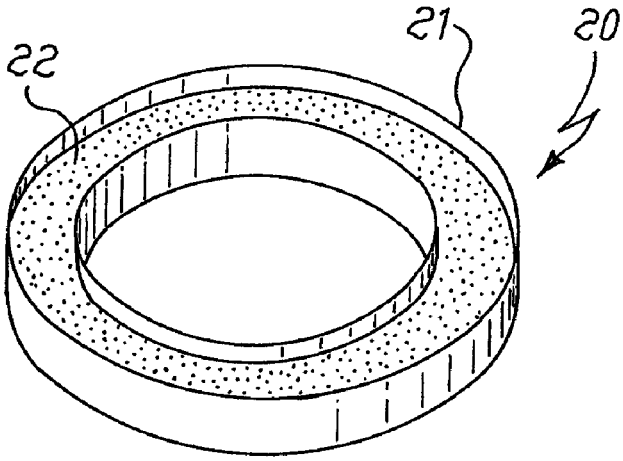
FIG. 2 shows a mercury dispensing device of the present invention which is formed as an annular container.
Figure 3:
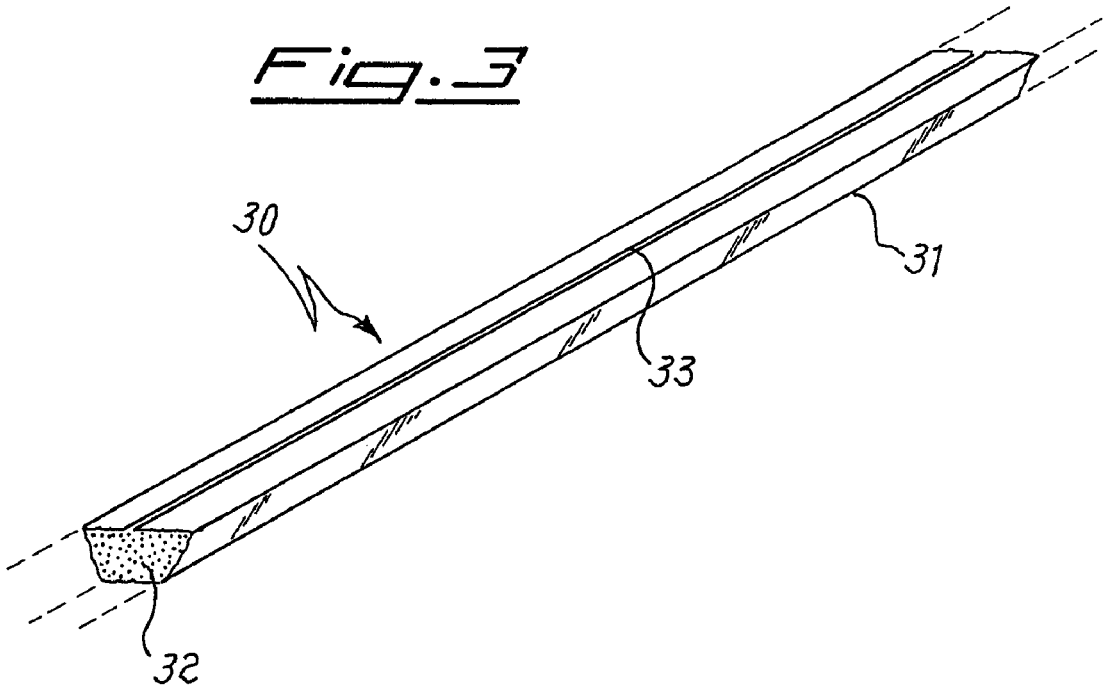
FIG. 3 shows a mercury dispensing device of the present invention which is formed by a wire-shaped container.

The compositions of the invention can easily be milled and subsequently sieved to obtain powders of the desired particle size fraction; for the applications of the present invention, the preferred fraction is that of the powders with dimensions smaller than 125 μm. These powders can be used to manufacture mercury dispensing devices of various shapes. In a first embodiment, represented in FIG. 1, the device, 10, is formed by a metallic strip, 11, onto at least one face of which is deposited at least one track, 12, of a powdered composition of the invention, either alone or in mixture with another material, such as a getter material for sorbing gaseous impurities in the lamp; as known in the field, it is also possible to produce strips bearing several tracks of different materials, for example one track of mercury dispensing material and one of a getter material, as disclosed in U.S. Pat. No. 6,107,737. A second possible embodiment of a mercury dispensing device in which the compositions of the invention can be used is represented in FIG. 2: the device 20 is formed as an annular container open at the top, 21, in which the powders of the mercury composition, 22, are present. Finally, another possible embodiment is that shown in FIG. 3, wherein the device 30 is formed by a wire-shaped container, 31, inside which the powders of the mercury composition 32 are contained and having a single opening in the form of a slit, 33, from which the mercury vapors can easily escape during the activation treatment. Apart from the already cited advantages of zero mercury release at temperatures below 500° C. and total release during activation, these compositions afford, with respect to the described combinations of materials with promoters, the advantage of requiring, for the production of the above described devices, the use of a powder of the single type, which considerably simplifies the manufacturing steps.

In a second aspect thereof, the invention deals with the manufacturing processes for the above described mercury dispensing compositions.

The compositions may be simply obtained by mixing powders of titanium, copper and one or more among tin, chromium and silicon with liquid mercury; placing the mixture in a suitable pressure-resistant container and heating the container (for example, by introducing it into an oven) to a suitable temperature, generally in the range of about 600-800° C. for a time comprised between 1 and 10 hours; therefore, after the system has cooled down to room temperature, extracting the reacted mixture from the container, and milling and sieving the resulting mixture to recover powders of the desired grain-size fraction.

However, it has been noted that better results, and in particular more homogeneous compositions, can be obtained if the desired elements other than mercury are previously reacted to form a pre-alloy, and powders of this pre-alloy are then reacted with mercury. Accordingly, a preferred embodiment of the process of the invention comprises the following steps:

preparation of an alloy of titanium, copper and one or more among tin, chromium and silicon, wherein the elements have a weight ratio corresponding to that desired for the final composition;

powdering said alloy;

mixing the powders of said alloy with liquid mercury in a weight ratio between alloy and mercury variable from about 2:1 to 1:1;

thermal treatment of the mixture thus obtained at a temperature between about 650 and 750° C., during a time of from 1 to 10 hours, within a pressure-proof sealed container.

This preferred process is then optionally followed by a further step of removal of the excess mercury by pumping during a thermal cycle, comprising at least one treatment at about 500° C. for at least 1 minute.

The various steps of the process allow some variants, as described in the following.

The first step consists in preparing an alloy containing the components of the final composition, except for mercury. This alloy is produced with a weight ratio among titanium, copper and one or more among tin, chromium or silicon, corresponding to the weight ratio of these elements in the final composition. For the production of this alloy it is possible to use raw metals in form of pieces or powders. The components can be mixed all together since the beginning, or it is possible to produce a pre-alloy with only copper and tin and/or chromium and/or silicon, and subsequently to mix the powders of this pre-alloy with titanium powder. The melting may be achieved in furnaces of whatever type, for example an arc furnace; however, the use of an induction furnace is preferable, because it allows to obtain the desired alloy in a homogenous form by a single melting step, while other techniques may require more melting steps in order to obtain the same result.

The reduction into powder of the alloy may be performed by whatever method known, e.g. with a jaw crusher. The powders produced in this way can then be sieved to select a desired particle size fraction: for example, for the successive step of the process it is preferable to use powders of the alloy with a particle size smaller than about 45 μm, because these dimensions enhance the reaction with mercury.

The following step consists in the production of the composition of the invention, by a reaction at high temperature of the previously produced alloy with mercury, this latter being in excess with respect to the desired composition. For this purpose the two components are mixed mechanically, in a weight ratio of alloy:mercury between 2:1 and 1:1, inside a container; the container is then sealed, resulting to be pressure-proof; it may be a quartz vial for the production of small quantities of the composition, or else an autoclave for larger quantities. The components are brought to reaction at temperatures between about 650 and 750° C., for a time of from 1 to 10 hours; preferred reaction conditions are a temperature of about 700° C. for a time between 3 and 6 hours. Upon cooling (which can be natural or forced) a nearly sintered compact body is obtained, but brittle and easy to mill; in analogy to other similar processes, this body will be defined in the following as "green body".

The green body is preferably submitted to a pumping process at relatively high temperatures for the removal of the excess mercury. This operation can be conducted on the green body as such, or it is possible to first subject the green body to milling and successively remove the excess mercury from the powders; the first method, in which one operates on the green body as such, is however preferred, because it avoids the risk that the lightest powders might be transported into the vacuum pumps, causing problems to these latter. The mercury removal operation can be performed in whatever evacuable and heatable chamber, for example the same autoclave for producing the composition. The thermal treatment of mercury removal comprises at least one phase in which the green body or the powders are maintained at 500° C. for at least 1 minute. The heating ramp from room temperature to 500° C. may be continuous and require, e.g., one hour; or it is possible to adopt a thermal cycle comprising a first ramp from room temperature up to a temperature between 300 and 350° C., a phase in which this temperature is maintained for a time between 1 and 20 hours, and a second ramp up to 500° C. (the whole cycle taking place under pumping). After cooling the desired composition is obtained, in the form of a compact body if the last operation has been performed on the green body, in which case the compact body then undergoes a milling step and recovery of the useful particle size fraction; or, already in form of powders if the last operation has been performed on powders; it is also possible to carry out this operation on a finished device of the type that is shown in the FIGS. 1 to 3 (or also of other type).

The invention will be further described in the following examples.

Example 1

This example relates to the preparation of a composition of the invention.

24.3 g of titanium foam, 70.9 g of copper powder and 4.8 g of tin powder are weighed. The three metals are placed in a crucible and then melted in an induction furnace under inert atmosphere. The produced ingot is milled and the powder is sieved, recovering the particle size fraction smaller than 125 μm. 7.5 g of this powder are mechanically mixed with 7.5 g of liquid mercury, and the mixture is sealed in a quartz vial under argon atmosphere. The vial is introduced into a sealed steel chamber which is airtight closed. This chamber is then inserted into a furnace, and heated up to 700° C. with the following thermal cycle:

ramp from room temperature to 500° C. in three hours;
holding at 500° C. for one hour;
ramp up to 600° C. in one hour;
holding at 600° C. for one hour;
ramp up to 700° C. in one hour;
holding at 700° C. for three hours;
natural cooling to room temperature in about 6 hours.

The vial breaks during the thermal treatment; by opening the chamber a compact green body is recovered. This green body undergoes the operation of removal of excess mercury, which is carried out through pumping while applying the following thermal cycle:

heating from room temperature to 320° C. in 2 hours;
holding at 320° C. for 20 hours;
heating at 500° C. in one hour;
holding at 500° C. for 5 minutes;
natural cooling to room temperature in about 4 hours.

The obtained product is milled, by recovering the particle size fraction smaller than 125 and a part of the powders is subjected to chemical analysis by fluorescence X-ray analysis, revealing a weight percent composition titanium 14.3%, copper 41.7%, tin 2.8% and mercury 41.2%.

Examples 2-5

These examples relate to the preparation of further compositions of the invention.

The procedure of Example 1 is repeated four times, starting with different ratios of the elements in the preparation of the alloy intended for reaction with mercury. The starting weights in grams of the elements employed in these four examples are given in Table 1.

TABLE 1

| Example | Ti | Cu | Sn | Cr | Si |
|---|---|---|---|---|---|
| 2 | 34.6 | 46.3 | 19.1 | / | / |
| 3 | 48.2 | 31.9 | 19.9 | / | / |
| 4 | 38.9 | 51.7 | / | 9.4 | / |
| 5 | 40.7 | 54.0 | / | / | 5.3 |

After reaction with mercury, part of the powders produced in each example is analyzed by means of X-ray fluorescence; the measured compositions are reported in Table 2.

TABLE 2

| Example | Ti | Cu | Sn | Cr | Si | Hg |
|---|---|---|---|---|---|---|
| 2 | 22.8 | 30.6 | 12.6 | / | / | 34.0 |
| 3 | 33.7 | 22.3 | 13.9 | / | / | 30.1 |
| 4 | 22.4 | 29.7 | / | 5.4 | / | 42.5 |
| 5 | 27.3 | 36.2 | / | / | 3.6 | 33.0 |

Example 6

This example relates to a simulation of the sealing process of a lamp, to verify the mercury release under these conditions from the compositions produced in examples 1 to 5.

Five devices of the type as shown in FIG. 2 are manufactured, by loading in the container 20 mg of the powders produced as the result of the procedure of examples 1 to 5. Each sample so prepared is introduced into a test chamber, the chamber is evacuated and maintained under pumping during the whole test, and the sample is inductively heated to 500° C. in 10 seconds and held at this temperature for 1 minute. From the weight difference before and after the test, the mercury emission from the sample at 500° C. is measured. It is found that for any of the five tested samples the amount of mercury released is less than 0.3% by weight (lower sensitivity limit of the measurement technique).

Example 7

This example relates to a simulation of the activation process of a device containing a composition of the invention, carried out on five samples prepared with the compositions produced in examples 1 to 5.

The series of tests of example 6 is repeated, heating however any time the sample under measure to 800° C. in about 10 seconds and holding the same at this temperature for about 20 seconds. By weight difference, the amount mercury evaporated in each test is measured. The results of these five tests are reported in Table 3, as weight percent of metal evaporated of the total amount present in the starting sample.

TABLE 3

| Example | Hg evaporated wt % |
|---|---|
| 1 | 83.0 |
| 2 | 86.6 |
| 3 | 80.1 |
| 4 | 84.0 |
| 5 | 95.0 |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. Mercury dispensing compositions comprising mercury, titanium, copper and one or more of tin, chromium and silicon, in which the elements are present according to the following weight percentages:
- titanium from 10% to 42%;
- copper from 14% to 50%;
- one or more elements chosen among tin, chromium and silicon from 1% to 20%;
- mercury from 20% to 50%,
- these compositions being obtained by forming a powdered pre-alloy of Ti, Cu and one or more elements chosen among Sn, Cr and Si and reacting the same with Hg.

2. Composition according to claim 1 in which the elements are present in the following weight percentages:
- titanium from 14% to 35%;
- copper from 20% to 45%;
- one or more elements chosen among tin, chromium and silicon from 2% to 14%;
- mercury from 30% to 45%.

3. Compositions according to claim 1 in which the elements are present in the following weight percentages:
- titanium 14.5±0.3%;
- copper 42.6±0.6%;
- tin 2.9±0.1%;
- mercury 40.5±4%.

4. Compositions of claim 1 in the form of powders with a particle size smaller than 125 μm.

5. Mercury dispensing devices containing powders (12, 22) according to claim 4.

6. Device (10) according to claim 5 in a form of a metallic strip (11) onto at least one face of which there is deposited at least one track (12) of said powders.

7. Device (20) according to claim 5 in a form of an annular container open at the top (21) in which said powders (22) are present.

8. Device (30) according to claim 5 in a form of a wire-shaped container (31) inside which said powders (32) are contained and having a single slit-shaped opening (33).

9. Process for the manufacturing of compositions of claim 1, comprising the following steps:
- preparation of an alloy of titanium, copper and one or more of elements among tin, chromium and silicon, wherein the three elements have a weight ratio corresponding to that desired for the final composition;
- powdering said alloy;
- mixing of the powder of said alloy with liquid mercury, in a weight ratio between alloy and mercury variable from about 2:1 to 1:1;
- thermal treatment of the mixture thus obtained at a temperature between about 650 and 750° C. for 1 to 10 hours, within a pressure-proof sealed container.

10. Process according to claim 9, further comprising an additional final step of removal of the excess mercury by pumping during a thermal cycle comprising at least one treatment at about 500° C. for at least 1 minute.

11. Process according to claim 9, in which said step of preparation of the alloy is carried out in two phases, producing first a pre-alloy of copper and one or more elements chosen among tin, chromium and silicon and using then the pre-alloy for the production of the alloy with titanium.

12. Process according to claim 9, in which said step of reducing the alloy into powder is followed by a step of sieving the powder and recovery of the particle size fraction smaller than 45 μm, which is subjected to the successive operation of mixture with mercury.

13. Process according to claim 9, wherein said step of thermal treatment is carried out at about 700° C. for 3 to 6 hours.

14. Process according to claim 10, wherein said step of mercury removal is carried out with a thermal cycle comprising a first climbing ramp from room temperature up to a temperature between 300 and 350° C., a holding phase at that temperature for a time from 1 to 20 hours, and a second climbing ramp from that temperature up to 500° C.

15. Process according to claim 10, in which said step of removal of excess mercury is carried out directly onto the product obtained after said thermal treatment.

16. Process according to claim 10, in which said step of removal of excess mercury is carried out after another step of milling of the product obtained in said thermal treatment.

* * * * *